US006615019B2

(12) United States Patent
Fujimoto

(10) Patent No.: US 6,615,019 B2
(45) Date of Patent: Sep. 2, 2003

(54) AUTOMATIC ORIGINAL FEEDING APPARATUS AND IMAGE FORMING APPARATUS PROVIDED WITH THE SAME

(75) Inventor: Hitoshi Fujimoto, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/013,465

(22) Filed: Dec. 13, 2001

(65) Prior Publication Data

US 2002/0085868 A1 Jul. 4, 2002

(30) Foreign Application Priority Data

Dec. 28, 2000 (JP) ..... 2000-402859

(51) Int. Cl.[7] ..... B65H 5/00; G03G 15/00

(52) U.S. Cl. ..... 399/367; 355/75; 399/107; 399/126; 399/380

(58) Field of Search ..... 399/126, 367, 399/377, 380, 107, 125; 355/75; 347/138, 152

(56) References Cited

U.S. PATENT DOCUMENTS 4,091,502 A * 5/1978 Little
4,520,977 A * 6/1985 Holzhauser et al. .... 399/367 X
5,126,787 A * 6/1992 Irie et al. ..... 355/75
5,351,112 A 9/1994 Naito et al. ..... 399/226
5,579,083 A 11/1996 Naito et al. ..... 355/400
5,819,151 A 10/1998 Naito et al. ..... 399/367
5,937,583 A * 8/1999 Lamperti
6,324,362 B1 * 11/2001 Yokohama et al. ..... 399/107
6,456,365 B1 * 9/2002 Hosaka et al. ..... 355/75
6,499,189 B2 * 12/2002 Kondo et al.

FOREIGN PATENT DOCUMENTS

JP 54-50319 4/1979
JP 08-029892 * 2/1996

* cited by examiner

*Primary Examiner*—Sophia S. Chen
(74) *Attorney, Agent, or Firm*—Fitzpatrick, Cella, Harper & Scinto

(57) ABSTRACT

An automatic original feeding apparatus mounted on the main body of an image forming apparatus has an automatic original feeding apparatus main body, and rotary supporting device for openably and closably mounting the automatic original feeding apparatus main body and an opening and closing mechanism interposed between the main body of the image forming apparatus and the automatic original feeding apparatus main body and permitting the rotating operation of the automatic original feeding apparatus main body relative to the main body of the image forming apparatus. A plurality of biasing members biases the automatic original feeding apparatus main body to offset the rotational force by gravity, and at least one of the biasing members has an adjusting mechanism for adjusting a biasing force.

13 Claims, 8 Drawing Sheets

AUTOMATIC ORIGINAL FEEDING APPARATUS AND IMAGE FORMING APPARATUS PROVIDED WITH THE SAME

BACKGROUND OF THE INVENTION

1. Field of the Invention

This invention relates to an automatic original feeding apparatus mounted on an image forming apparatus such as a printer or a copier.

2. Description of the Related Art

There are known image forming apparatuses such as printers and copiers having an automatic original feeding apparatus mounted thereon.

This automatic original feeding apparatus is openably and closably mounted on the upper surface of the main body of the image forming apparatus on which platen glass is disposed, and is designed to assume a closed position for covering the platen glass and an opened position in which it has been raised upwardly. The automatic original feeding apparatus has its closed position or opened position selected depending on whether an original used for image formation is a sheet-like one or a found one such as a book.

FIG. 9 of the accompanying drawings shows a hinge (rotary supporting mechanism) 50 for openably and closably supporting the main body of the automatic original feeding apparatus relative to the main body of the image forming apparatus. The hinge 50 comprises a cam 53 fixed to the main body 1 side of the image forming apparatus, and a hinge frame 51 fixed to the main body 2A side of the automatic original feeding apparatus, the cam 53 and the hinge frame 51 being rotatably connected together by a rotary shaft 52. The hinge 50 further comprises a spring (compression spring) 56 interposed between a housing 55 positioned on the hinge frame 51 through a slide shaft 61 and another housing 54 slidably supported by the hinge frame 51. The housing 54 is urged against the cam 53 by the spring 56 and conversely, the main body 2A of the automatic original feeding apparatus is biased counter-clockwisely about the rotary shaft 52 by the cam 53 through the spring 56. The rotational force of the main body 2A of the automatic original feeding apparatus about the rotary shaft 52 which is attributable to the gravity thereof is offset by this biasing. Therefore, the opening and closing operation of the main body 2A of the automatic original feeding apparatus becomes light. The spring 56 has its spring length gradually extended to decrease its biasing force by the housing 54 moving after the cam 53 as the main body 2A of the automatic original feeding apparatus is opened. This corresponds to the fact that the rotational force by the gravity becomes smaller as the opening angle of the main body 2A of the automatic original feeding apparatus becomes greater. That is, design is made such that at whatever position the main body 2A of the automatic original feeding apparatus may be opened, the rotational force by the gravity and the rotational force by the spring 56 are substantially offset by each other.

Also, Japanese Patent Application Laid-Open No. 54-50319 discloses an adjusting mechanism capable of adjusting the compressive force of a spring in accordance with the gravity of an original pressure plate provided on the upper portion of the main body of a copier and capable of being stopped at a predetermined angle for the hinge member of the original pressure plate.

However, according to the above-described automatic original feeding apparatus 2, for example, one used in a high-speed image forming apparatus great in the number of developed sheets per unit time is heavy and accordingly, as the spring 56 used in the hinge 51, use is made of one strong in spring force. Therefore, the unevenness of the spring force becomes great or the spring force is varied by long-period use. There has also been the problem that when the spring force strengthens, the closed position of the automatic original feeding apparatus deviates relative to the main body of the image forming apparatus and the automatic original feeding apparatus becomes incapable of being disposed at a regular position, and when conversely the spring force is too weak, the automatic original feeding apparatus will fall if it is released in its half-opened state.

Also, the compression spring adjusting mechanism disclosed in the above-mentioned Japanese Patent Application Laid-Open No. 54-50319 has suffered from the problem that when a driver or the like is to be inserted into a groove formed in the rear end of an adjusting screw and be rotated to thereby adjust the compressive forced of the spring, a very great force is required and the working property of the adjusting work is bad. Also, a very great force is applied to the groove formed in the rear end of the adjusting screw, and this has led to the possibility of damaging the adjusting screw.

SUMMARY OF THE INVENTION

The present invention has been made in view of the above-noted circumstances and has as its object to provide an automatic original feeding apparatus of which the opening and closing relative to the main body of an image forming apparatus can be done well and in which the adjustment of a biasing force for assisting good opening and closing can be effected simply, and an image forming apparatus provided with the same.

The present invention for achieving the above object is an automatic original feeding apparatus mounted on the main body of an image forming apparatus for conveying an original to a predetermined position in the main body of the image forming apparatus, characterized by the provision of an automatic original feeding apparatus main body and rotary supporting means for openably and closably mounting the automatic original feeding apparatus main body relative to the main body of the image forming apparatus, the rotary supporting means including an opening and closing mechanism interposed between the main body of the image forming apparatus and the automatic original feeding apparatus main body and permitting the rotating operation of the automatic original feeding apparatus main body relative to the main body of the image forming apparatus, and a plurality of biasing members for biasing the automatic original feeding apparatus main body so as to offset the rotational force by the gravity thereof, at least one of the biasing members having an adjusting mechanism for adjusting the biasing force thereof.

Also, the present invention is the above-described automatic original feeding apparatus characterized in that the opening and closing mechanism has an immovable member fixed to the main body side of the image forming apparatus, a movable member fixed to the automatic original feeding apparatus main body side, and a rotary shaft for rotatably connecting the movable member to the immovable member.

Also, the present invention is the above-described automatic original feeding apparatus characterized in that the biasing members are interposed between the immovable member and the movable member.

Further, the present invention is an image forming apparatus provided with automatic original feeding means for conveying an original to a predetermined location in the main body of the image forming apparatus, reading means for reading the image information of the original conveyed to the predetermined location, and image forming means for forming an image on a sheet material on the basis of the image information read by the reading means, characterized in that the automatic original feeding means is the above-described automatic original feeding apparatus.

DESCRIPTION OF THE PREFERRED EMBODIMENTS

Some embodiments of the present invention will hereinafter be described with referenced to the drawings.

An image forming apparatus according to the present invention is provided with the main body of the image forming apparatus and an automatic original feeding apparatus. The main body of the image forming apparatus, the automatic original feeding apparatus and the opening and closing mechanism of the automatic original feeding apparatus which is the characteristic portion of the present invention will hereinafter be described in the named order.

Figure 1:
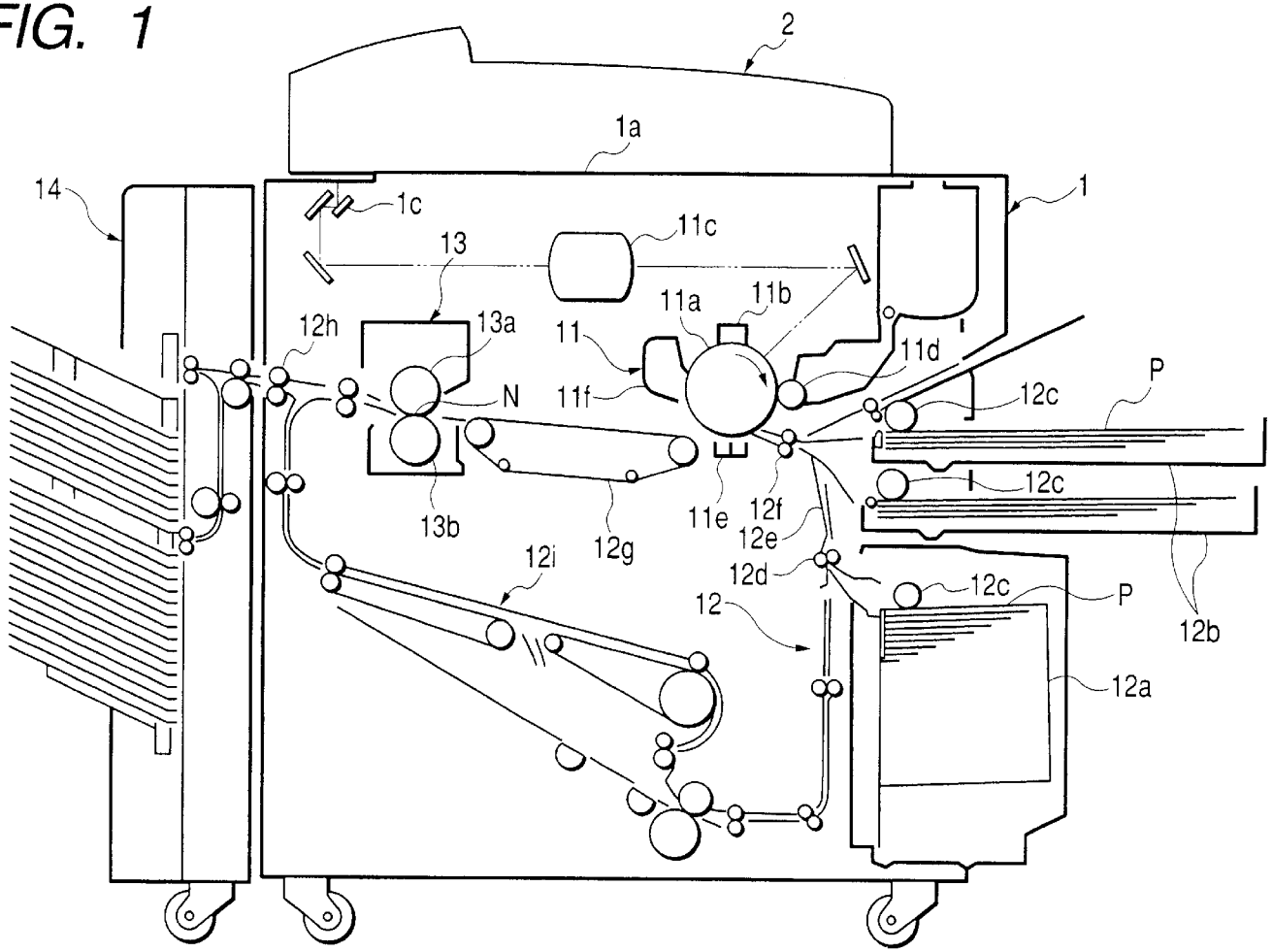
FIG. 1 is a longitudinal cross-sectional view schematically showing the construction of the main body of an image forming apparatus.

FIG. 1 shows an example of the main body 1 of the image forming apparatus (hereinafter simply referred to as the main body of the apparatus). FIG. 1 is a longitudinal cross-sectional view of the main body 1 of the apparatus along the conveying direction of a sheet material P.

As shown in FIG. 1, the main body 1 of the apparatus is provided with an image forming portion 11, a feeding and conveying portion 12 and a fixing portion 13.

The image forming portion 11 has a photosensitive drum 11*a* as an image bearing member, and a primary charger (charging means) 11*b*, an exposing device (exposing means) 11*c*, a developing device (developing means) lid, a transfer separation charger (transfer separating means) 11*e* and a cleaner (cleaning means) 11*f* disposed substantially in succession along the direction of rotation (clockwise direction in FIG. 1) of the photosensitive drum 11*a*.

Such an image forming portion 11 uniformly charges the surface of the photosensitive drum by the primary charger 11*b*, and effects exposure conforming to image information by the exposing device 11*c* to thereby form an electrostatic latent image. Further, it causes a toner to adhere to the electrostatic latent image by the developing device 11*d* to thereby develop the electrostatic latent image as a toner image, and thereafter transfers the toner image onto the sheet material P (e.g. paper) by the transfer separation charger lie, and separates this sheet material P from the surface of the photosensitive drum. On the other hand, the surface of the photosensitive drum 11*a* after the transfer of the toner image has any residual toner thereon removed by the cleaner 11*f* and is used for the next image formation.

The whole of the image forming portion 11 forms a toner image on the surface of the sheet material P in conformity with the image information.

The feeding and conveying portion 12 has, substantially in succession from the upstream side with respect to the conveying direction of the sheet material P, a feed deck 12*a*, feed cassettes 12*b*, feed rollers 12*c*, conveying rollers 12*d*, conveyance guide 12*e*, registration rollers 12*f*, a conveying belt 12*g*, discharge rollers 12*h* and a re-conveying mechanism 12*i*.

Such a feeding and conveying portion 12 feeds the sheet materials P stacked on the feed deck 12*a* or contained in the feed cassettes 12*b* one by one by the feed roller 12*c*, and conveys the sheep material P to the registration rollers 12*f* along the conveyance guide 12*e* by the conveying rollers 12*d*. The registration rollers 12*f* once stops the sheet material P conveyed thereto, and thereafter supplies it to the photosensitive drum 11*a* in timed relationship with the toner image on the photosensitive drum 11*a*. The conveying belt 12*g* conveys the sheet material P after the transfer of the toner image thereto the fixing portion 13, and the discharge rollers 12*h* discharge the sheet material P after fixing to an option sorter 14. When image formation is to be effected again on the sheet material P after the fixing of the toner image, the sheet material P after the fixing of the toner image may be again sent to the image forming portion 11 by the re conveying mechanism 12*i*.

The fixing portion 13 has a fixing roller 13*a* containing a heater therein, and a pressure roller 13*b* brought into pressure contact therewith from below it.

Such a fixing portion 13 heats and pressurizes the sheet material P conveyed thereto with an unfixed toner image borne on its surface while nipping and conveying the sheet material P by the fixing nip portion N between the fixing roller 13*a* and the pressure roller 13*b*, to thereby fix the toner image on the surface of the sheet material P.

The main body 1 of the apparatus has been described above.

The main body 1 of the apparatus of the above-described construction has platen glass 1*a* provided on the upper surface thereof, and is designed to form a toner image on the basis of the image information of an original S placed on the platen glass 1*a*. There are two methods of placing the original S on the platen glass 1*a* at this time: one is a method of automatically placing the original by the automatic original feeding apparatus 2, and the other is a method of opening the automatic original feeding apparatus 2 to thereby enable a user to manually place the original. For example, when the original S is a book or one found as by pasting or staple, the automatic original feeding apparatus 2 cannot be used and therefore, like the latter, design is made such that the user manually places the original.

Figure 2:
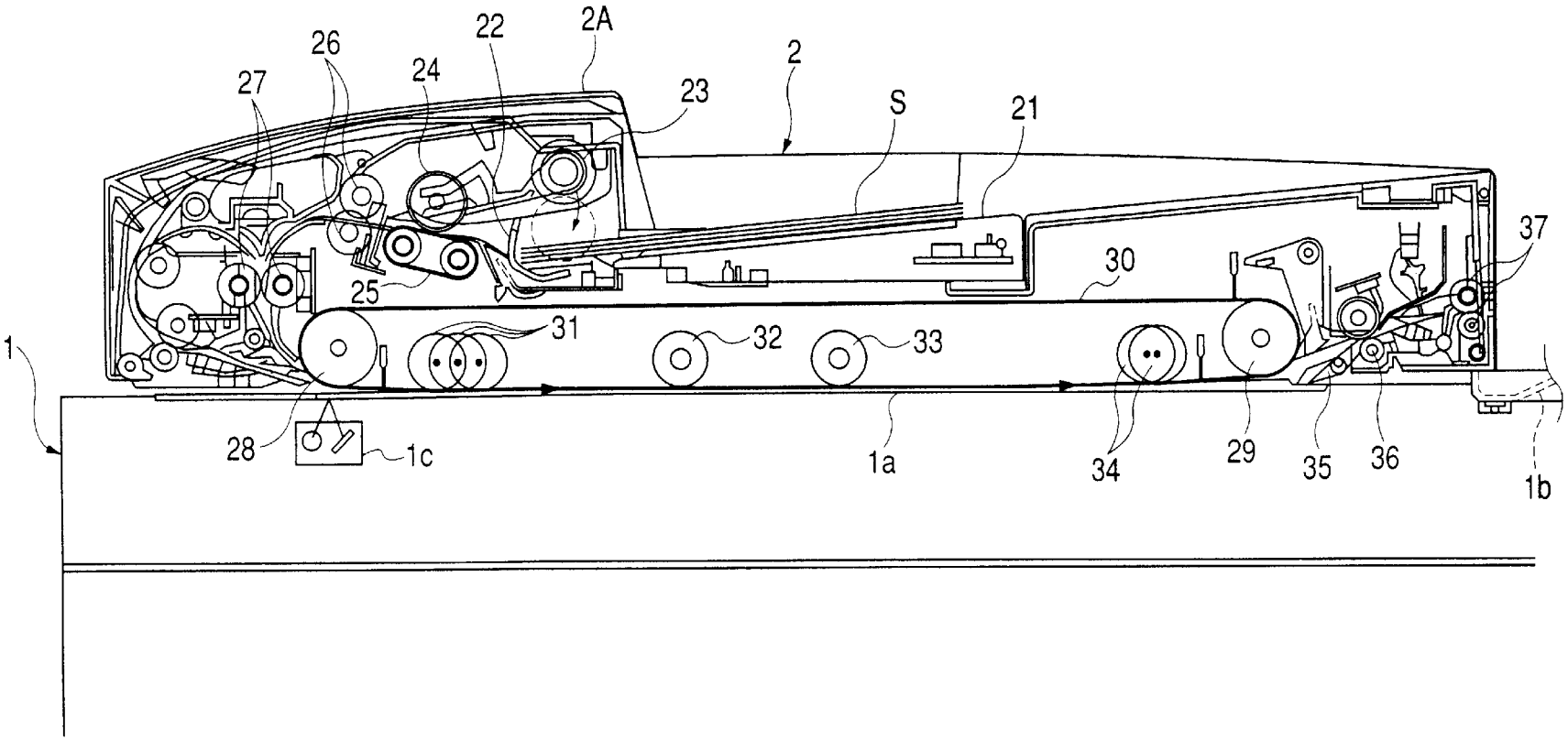
FIG. 2 is a longitudinal cross-sectional view schematically showing the construction of the main body of an automatic original feeding apparatus.

The automatic original feeding apparatus 2 will now be described with reference to FIG. 2. FIG. 2 is a longitudinal cross-sectional view along the conveying direction of the original S. The automatic original feeding apparatus 2 in the present embodiment is provided with an automatic original feeding apparatus main body 2A and a hinge (rotary supporting means) 50. In the following description, however, the automatic original feeding apparatus main body 2A will also be called the automatic original feeding apparatus 2 as long as it is not particularly necessary to distinguish between the two.

As shown in FIG. 2, the automatic original feeding apparatus 2 has a sheet feeding and stacking stand 21, a shutter 22, a sheet feeding roller 23, a separating roller 24, a separating belt 25, conveying roller 26, registration rollers 27, a conveying belt 30 passed over a conveying drive roller 28 and a conveying driven roller 29, a train of pressing runners 31, 32, 33, 34, a sheet discharging flapper 35, a sheet discharging intermediate roller 36 and sheet discharging rollers 37 disposed substantially in succession from the upstream side along the conveying direction of the original S. The scanner 1*c*, the platen glass 1*a* and the sheet discharge tray 1*b* of the main body 1 side of the apparatus are disposed below the above-mentioned conveying drive roller 28, conveying belt 30 and sheet discharging rollers 37, respectively.

The conveyance of the original S and the reading of image information by the automatic original feeding apparatus 2 of such a construction will hereinafter be described.

The originals S are set on the sheet feeding and stacking stand 21 of the automatic original feeding apparatus 2. The feeding and conveyance of the originals S are started by an image formation starting signal from the main body 1 of the apparatus. The shutter 22 is first lowered relative to the originals S on the original stacking stand 21 rammed against the shutter 22 and positioned thereby and opens an original conveying path. Thereafter, the sheet feeding roller 23 is lowered onto the originals S, and thereafter is clockwisely rotated to thereby convey the originals S leftwardly as viewed in FIG. 2, and the originals S are separated one by one by the separating roller 24 and the separating belt 25. The original S separated into one is further conveyed by the conveying rollers 26, and the leading end of the original arrives at the nip between the registration rollers 27 being stationary. Since the registration rollers 27 are stationary, the original S cannot have its leading end moved forwardly of the nip and has its trailing end pushed and therefore, a loop is formed intermediately thereof. Thereby, the original S is aligned in a direction orthogonal to the conveying direction with its leading end at the registration rollers 27. That is, the original S, even if it is being skew-fed by sheet feeding, separation, etc., has its skew feeding corrected. After the formation of a predetermined loop, the registration rollers 27 start to be rotated and the conveyance of the original S is continued.

Also, the conveying belt 30 is resiliently stretched between the conveying drive roller 28 and the conveying driven roller 29 by a spring member or the like. The train of belt pressing runners 31, 32, 33, 34 for pressing the conveying belt 30 against the platen glass 1*a* of the main body 1 side of the apparatus to thereby create a conveying force between themselves and the platen glass are disposed between the conveying drive roller 28 and the conveying driven roller 29 and inside the conveying belt 30, and a belt pressing roller (not shown) for pressing the conveying belt 30 against the platen glass 1*a* uniformly in the widthwise direction thereof is disposed in a direction perpendicular to the conveying direction of the original.

At the registration rollers 27, the original S is conveyed between the conveying belt 30 and the platen glass 1*a* and is stopped at a predetermined position (reading position) on the platen glass 1*a*. After the original S has been stopped, the scanner 1*c* is moved rightwardly as viewed in FIG. 2 while applying light to the original S, and receives the reflected light thereof to thereby read the image information of the original S.

Thereafter, the original S having had its image information read passes from on the platen glass 1*a* to the sheet discharging flapper 35 and passes the sheet discharging intermediate roller 36 and the sheet discharging rollers 37 and is discharged onto the sheet discharge tray 1*b*.

What has been described above is the flow of the conveyance of the original S and the flow of the reading of the image information by the automatic original feeding apparatus 2.

Figure 3:
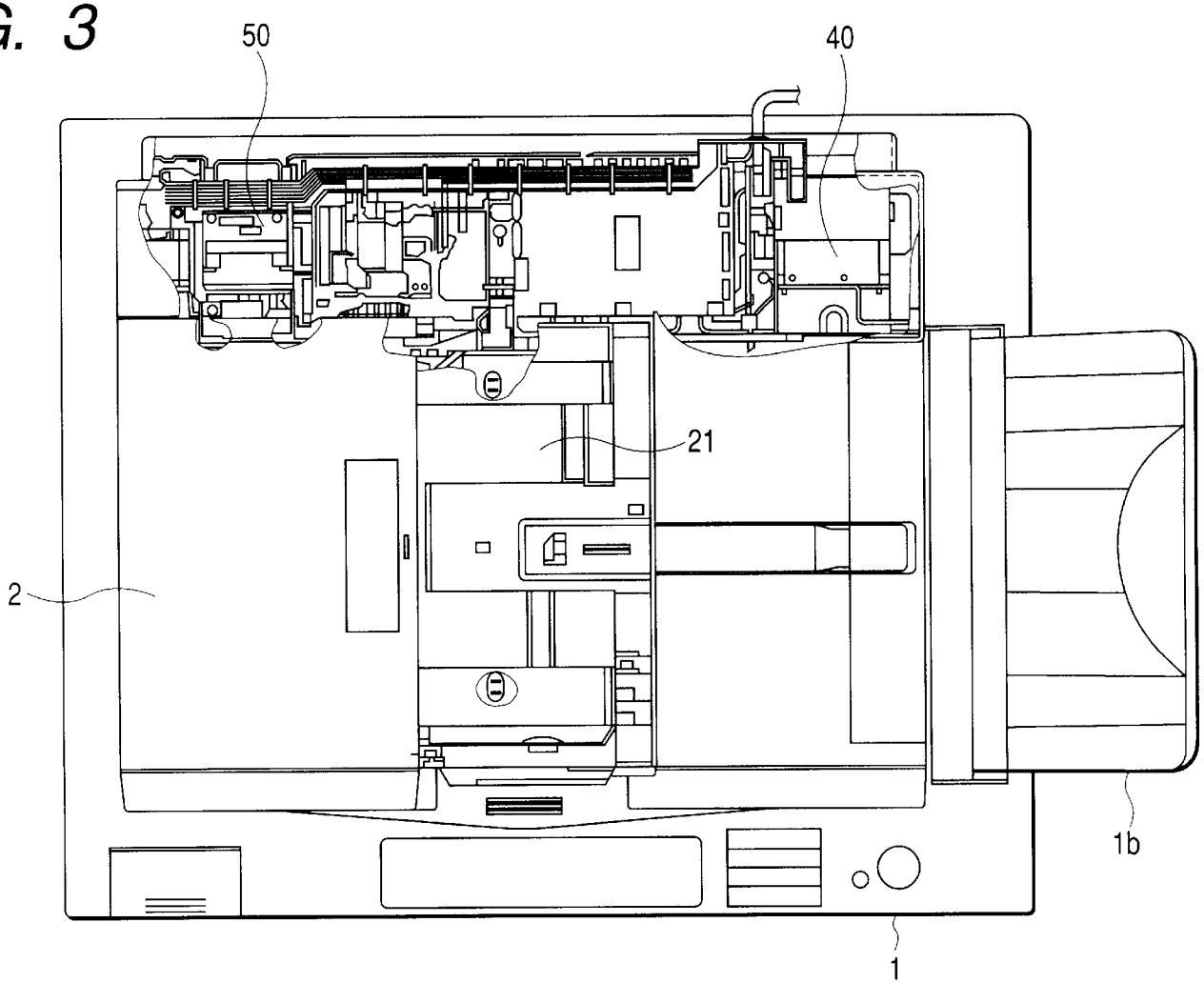
FIG. 3 is a top plan view of the image forming apparatus.

The feature of the present embodiment will now be described with reference to FIGS. 3 to 6. FIG. 3 is a top plan view of the main body 1 of the apparatus and the automatic original feeding apparatus 2 disposed so as to cover the upper surface thereof. In the following description, the "lower side", the "upper side", the "left side" and the "right side" in FIG. 3 will be described as the "front side", the "rear side (back side)", the "left side" and the "right side", respectively. The automatic original feeding apparatus 2 in FIG. 3 is partly sectioned in order to show the attached states of the hinges (rotary supporting means) 40 and 50. The hinges 40 and 50 are attached to the right side and the left side, respectively, on the rear side (back side) of the main body 1 of the apparatus in spaced apart relationship with each other.

Figure 4:
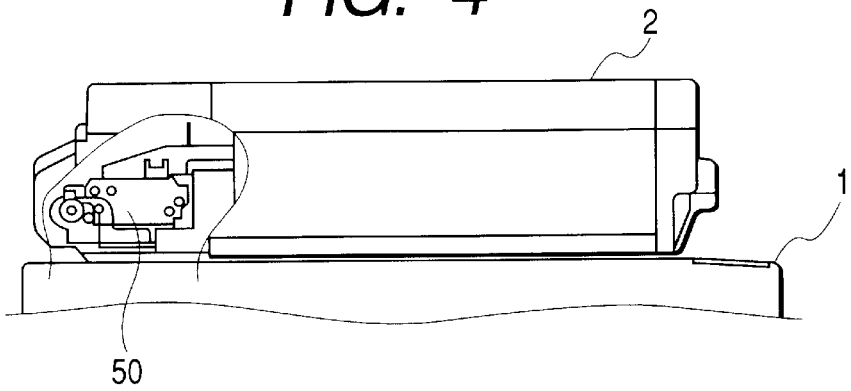
FIG. 4 is a partly broken-away left side view of an automatic original feeding apparatus in Embodiment 1 in its closed state.
Figure 5:
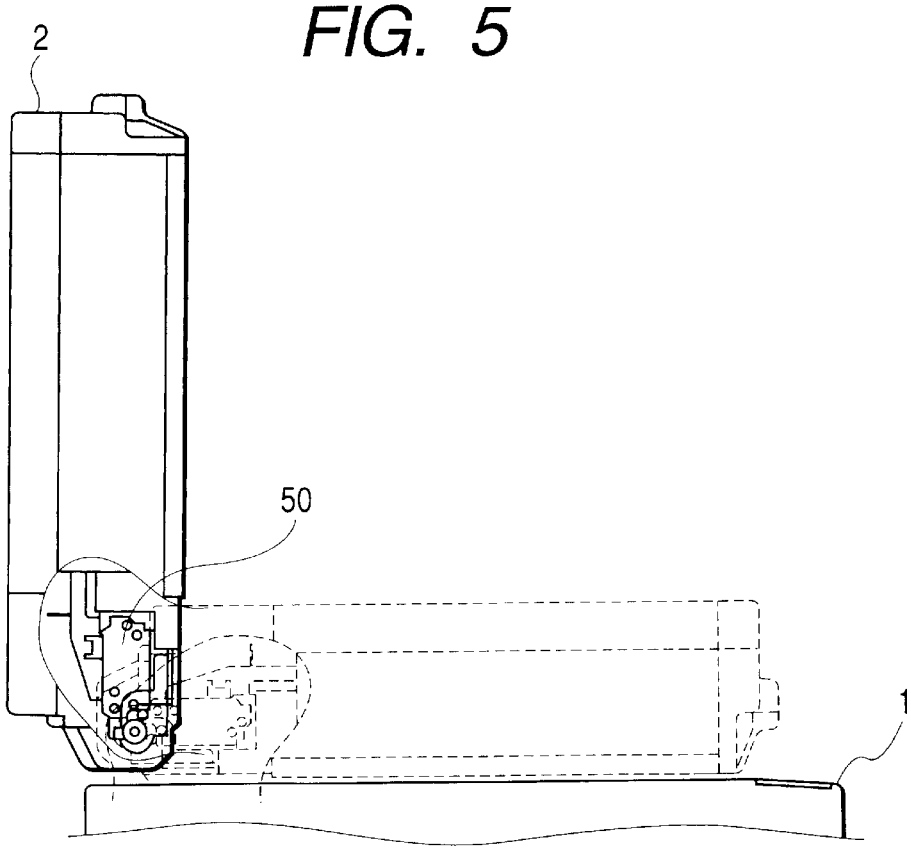
FIG. 5 is a partly broken-away left side view of the automatic original feeding apparatus in Embodiment 1 in its opened state.

FIG. 4 is a left side view of the automatic original feeding apparatus 2 and shows the state of the hinge 50 when the automatic original feeding apparatus 2 has assumed a closed position relative to the main body 1 of the apparatus, that is, when the automatic original feeding apparatus 2 has assumed a prone posture so as to cover the upper surface of the main body 1 of the apparatus. On the other hand, FIG. 5 shows the state of the hinge 50 when the automatic original feeding apparatus 2 has assumed an opened position relative to the main body 1 of the apparatus, that is, when the automatic original feeding apparatus 2 has assumed an upright posture relative to the main body 1 of the apparatus. The automatic original feeding apparatus 2 is adapted to be stopped stably by the operational effect of the present embodiment which will be described later without being supported by the user's hand when it has assumed the closed position as well as when it has assumed the upright position.

REFERENCE EXAMPLE

Figure 6:
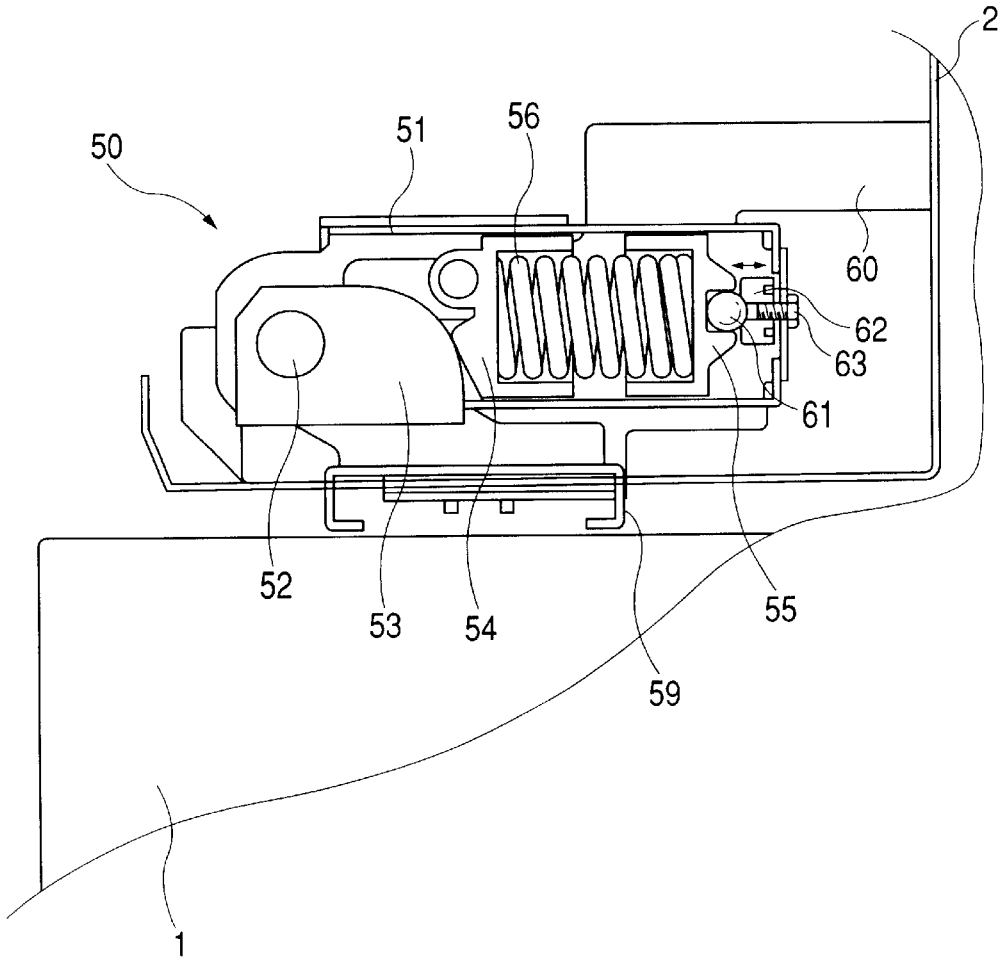
FIG. 6 is a longitudinal cross-sectional view of a hinge when an automatic original feeding apparatus in a reference example is in its closed state.

FIG. 6 shows a longitudinal cross-sectional view of the hinge 50 in the state of FIG. 4. The hinge 50 will be described as a reference example with reference to FIG. 6. The hinge 50 is rotary supporting means for openably and closably mounting the automatic original feeding apparatus 2 with respect to the main body 1 of the image forming apparatus. The hinge 50 is fixed (fastened) to the automatic original feeding apparatus 2 by a mounting plate 60 constituting a portion of a hinge frame 51. The hinge 50 is divided into a member (movable member) effecting rotative movement with the automatic original feeding apparatus 2 like the hinge frame 51, and members (immovable members) fixed to the main body 1 of the apparatus and immovable like a core stand 59 and a cam 53. The movable member and the immovable members are pivotally (rotatably) connected together by a rotary shaft 52. A spring (compression spring) 56 as a biasing member which is a construction in the above-described movable member is disposed between independent housings 54 and 55. The spring 56 acts to widen the space between these housings 54 and 55, and one housing 55 has its moved position regulated by a sliding shaft 61, a sliding stand 62 and an adjusting screw (adjusting mechanism) 63. The sliding stand 62 is moved in the directions of arrow (rightward and leftward directions) in FIG. 6 by adjusting (fastening or loosening) the adjusting screw 63, and the sliding shaft 61 follows the movement of the sliding stand and therefore, the spring length of the spring 56 can be changed to thereby change the spring force (biasing force) thereof. The other housing 54 is movable until it abuts against the cam 53. The pressure contact force between the housing 54 and the cam 53 offsets the gravity of the automatic original feeding apparatus 2 and mitigates the operational load with which the user opens or closes the automatic original feeding apparatus. That is, the automatic original feeding apparatus 2 is set such that the gravity thereof acts clockwisely about the rotary shaft 52, whereas the spring force acts counter-clockwisely by the cam 53 and the spring 56 and the spring force at this time substantially offsets the gravity.

In the aforedescribed hinge 50, the adjusting screw 63 for adjusting the acting force thereof can be adjusted from the outside of the hinge 50 by a simple tool or the like. Thereby, the hinge 50 is assembled as a unit and further, after it is connected to the automatic original feeding apparatus 2, the spring force in the hinge 50, i.e., the operating force when the automatic original feeding apparatus is opened or closed, is adjustable, and is adjustable even when the operating feeling of the hinge 50 changes after the user has used the apparatus for a long period and therefore, the spring force can be made to become a suitable operating force. While in the foregoing, one hinge 50 only has been described, the other hinge 40 may be of a construction similar to that of one hinge 50 or of a construction having not the adjusting mechanism such as the spring 56.

<Embodiment 1>

Figure 7:
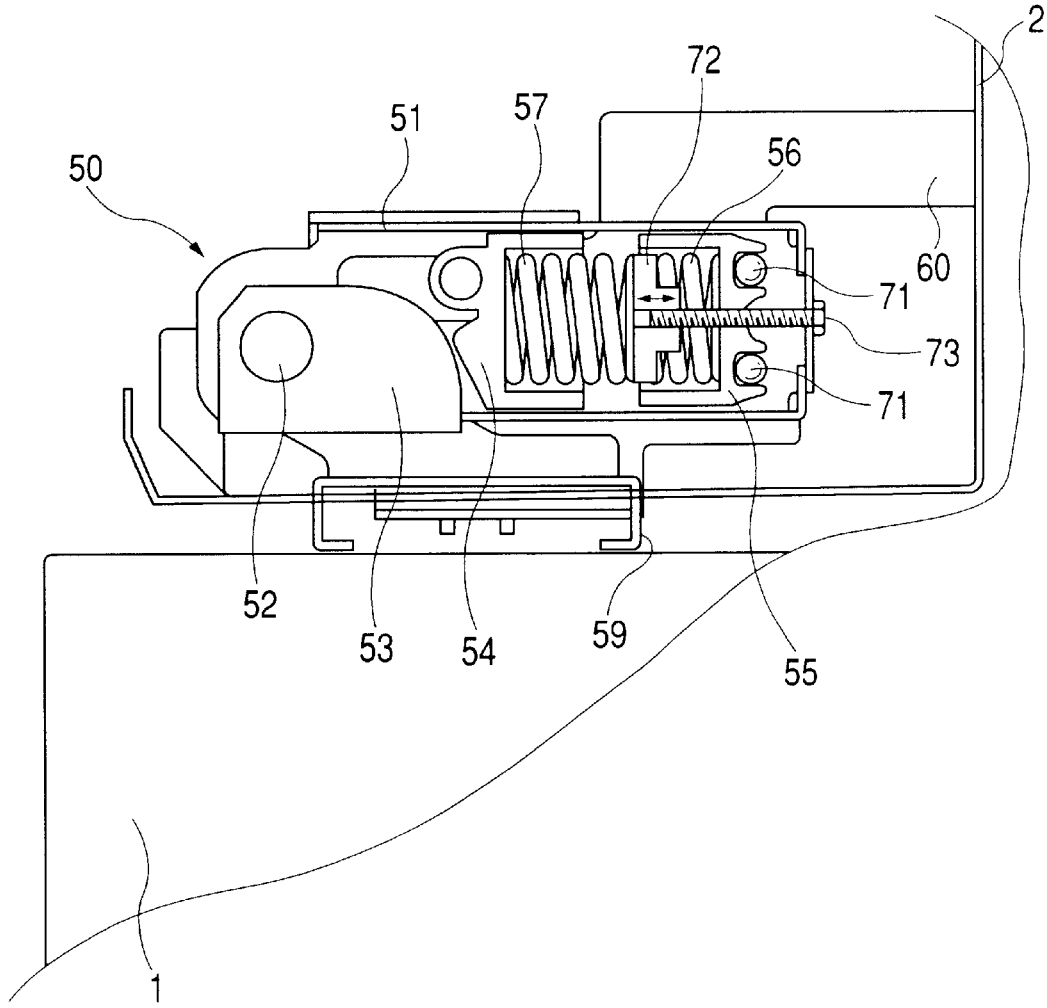
FIG. 7 is a longitudinal cross-sectional view of a hinge when the automatic original feeding apparatus in Embodiment 1 is in its opened state.

While in the above-described reference example, an adjusting mechanism for varying the operating force of the above-described spring is provided for the spring 56 in a hinge 50, in the present embodiment, two kinds of springs 56 and 57 are juxtaposed in the hinge 50, and this will now be described with reference to FIG. 7.

Of the springs 56 and 57 acting on the opening-closing force of the automatic original feeding apparatus 2, one spring 56 is disposed between the housings 54 and 55. The housing 55 has its other end regulated by a fixed shaft 71. The other housing 54 is movable until it abuts against the cam 53, and the spring 56 acts with a spring force corresponding to a change in the contact resulting from the opening and closing of the automatic original feeding apparatus 2. The spring 57 has its one end regulated by an adjusting stand 72 and has its other end regulated by the housing 54. What makes the housing 54 abut against the cam 53 and act is the same as the aforedescribed spring 56, but the adjusting stand 72 which is one end of the spring 57 is movable for adjustment in the directions of arrow (the rightward and leftward directions) by an adjusting screw to thereby make the acting force of the spring 57 adjustable.

Usually, the spring provided with an adjusting mechanism is set to a weaker spring force to improve the adjusting work property than the spring not provided with an adjusting mechanism.

Also, the adjusting screw 73 is operable from the outside of the hinge 50 by a simple tool or the like, whereby the hinge 50 is assembled as a unit and further, after it is connected to the automatic original feeding apparatus 2, the spring force in this hinge 50, i.e., the operating force with which the automatic original feeding apparatus is opened or closed, is adjustable, and even if the operating feeling of the hinge 50 changes after the user has used the apparatus for a long period, the operating force is adjustable and can therefore be rendered into a suitable operating force. In addition, in the present embodiment, the adjustment of the adjusting screw 73 can be effected with a smaller force than in the case of the aforedescribed reference example.

<Embodiment 2>

Figure 8:
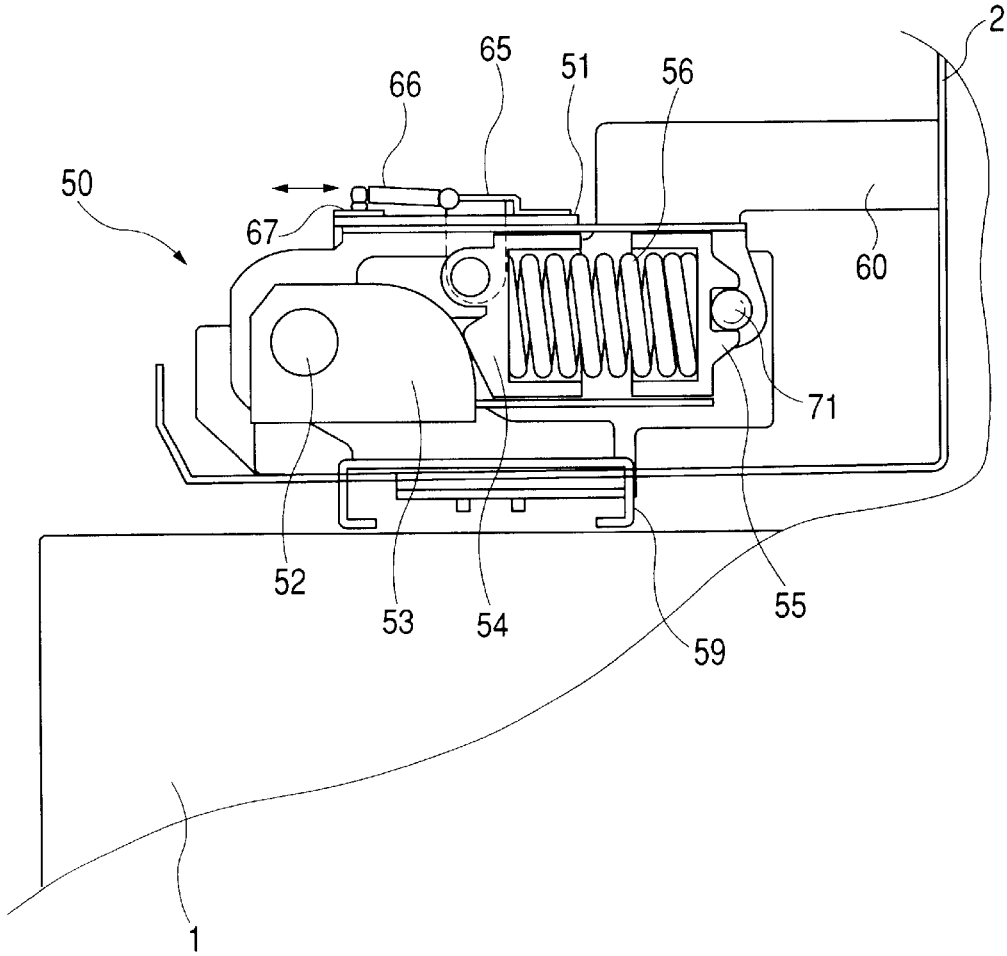
FIG. 8 is a longitudinal cross-sectional view of a hinge when an automatic original feeding apparatus in Embodiment 2 is in its opened state.
Figure 9:
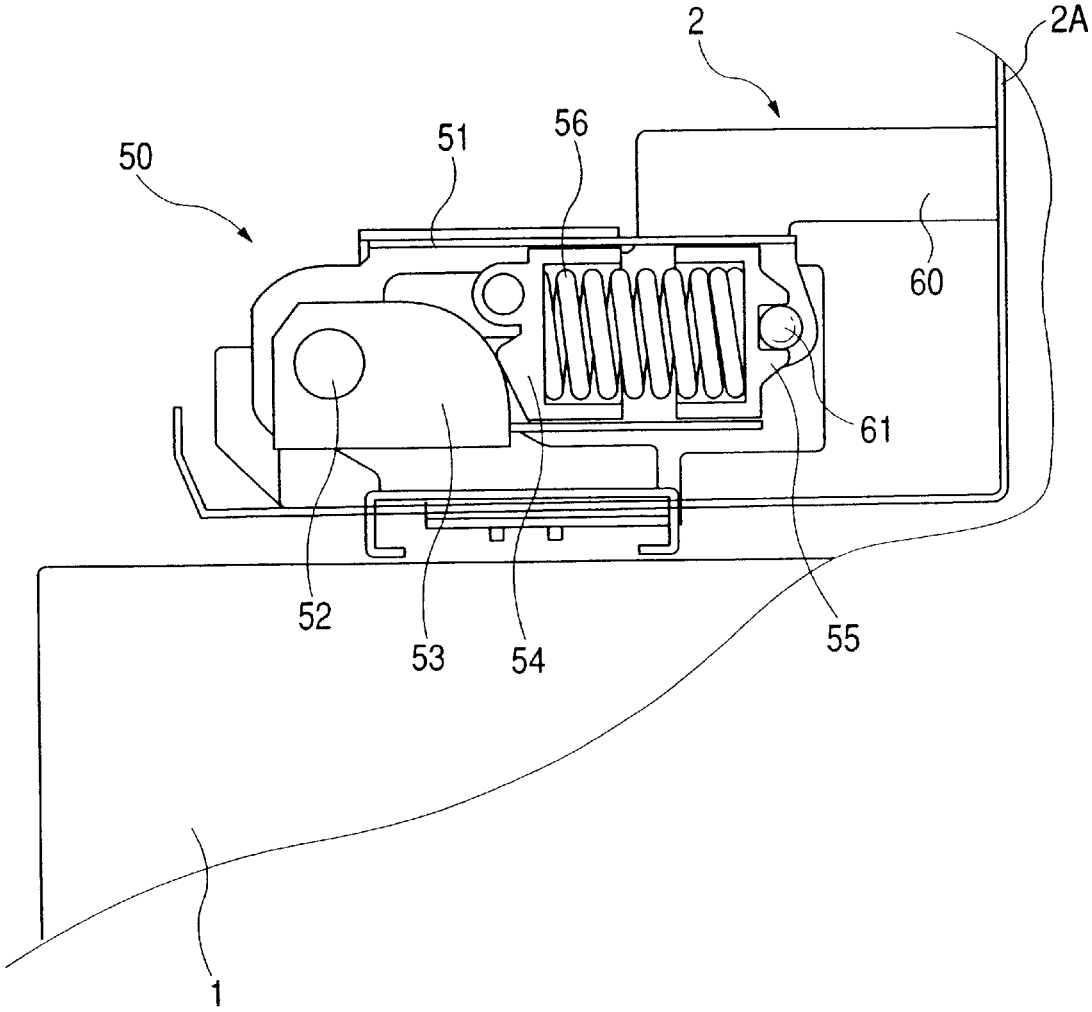
FIG. 9 PRIOR ART
FIG. 9 is a longitudinal cross-sectional view of a hinge when an automatic original feeding apparatus according to the prior art is in its closed state.

This embodiment will hereinafter be described with reference to FIG. 8. In FIG. 8, a hinge 50 is fastened to the automatic original feeding apparatus 2 by a mounting plate 60 provided on a hinge frame 51, and is divided into a portion (movable portion) effecting rotative movement with the automatic original feeding apparatus 2 and portions (immovable portions) connected to the image forming apparatus and immovable like a core stand 59 and a cam 53.

The movable portion and the immovable portions are rotatable connected together by a rotary shaft 52. As regards the construction in the above-described movable portion, a spring 56 is disposed between independent housings 54 and 55, and a spring 56 acts to widen the space between these housings 54 and 55, and one housing 55 has its position regulated by a fixed shaft 71. The other housing 54 is movable until it abuts against the cam 53. A housing fixing stand 65 is engaged with the housing 54 and a portion thereof protrudes outwardly of the hinge 50.

An adjusting spring 66 is hooked to this protruding portion and contributes to a force which makes the housing 54 abut against the cam 53. The other end of this adjusting spring 66 is designed to be hooked to the spring hooking portion of a sliding plate 67. This sliding plate 67 is movable in the directions of arrow (rightward and leftward directions) by a simple tool such as a driver, and by adjusting this sliding plate 67, it is possible to vary the amount of displacement of the adjusting spring 66 to thereby adjust the spring force. Thereby, the hinge 50 is assembled as a unit and further, after it is connected to the automatic original feeding apparatus 2, the spring force in the hinge 50, i.e., the operating force with which the automatic original feeding apparatus is opened or closed, is adjustable, and even if the operating feeling of the hinge 50 changes after the user has used the apparatus for a long period, the operating force is adjustable and can therefore be rendered into a suitable operating force.

As described above, according to the present invention, provision is made of an adjusting mechanism capable of adjusting the biasing force of a biasing member for biasing the automatic original feeding apparatus main body so as to offset the rotational force by the gravity thereof, whereby even when the biasing force of the biasing member becomes uneven or is changed by the long-period use of the apparatus, the biasing force can be set to a suitable magnitude by the adjusting mechanism and therefore, the opening and closing of the automatic original feeding apparatus main body relative to the main body of the image forming apparatus can be effected well.

Also, the biasing force which biases the automatic original feeding apparatus main body so as to offset the rotational force by the gravity thereof is set in parallel in a plurality of biasing members, whereby the adjustment can be effected with a small force.

What is claimed is:

1. An automatic original feeding apparatus mounted on a main body of an image forming apparatus for conveying an original to a predetermined location in the main body of said image forming apparatus, comprising:

an automatic original feeding apparatus main body; and supporting means for openably and closably mounting said automatic original feeding apparatus main body with respect to the main body of said image forming apparatus;

said supporting means including:

an opening and closing mechanism interposed between the main body of said image forming apparatus and said automatic original feeding apparatus main body and permitting a rotating operation of said automatic original feeding apparatus main body relative to the main body of said image forming apparatus; and a plurality of biasing members for biasing said automatic original feeding apparatus main body so as to offset a rotational force by a gravity thereof, and mitigate an operational load with which said automatic original feeding apparatus is opened or closed;

at least one of said biasing members having an adjusting mechanism for adjusting a biasing force.

2. An automatic original feeding apparatus according to claim 1, wherein said opening and closing mechanism has;

an immovable member fixed to the main body side of said image forming apparatus;

a movable member fixed to said automatic original feeding apparatus main body side; and a rotary shaft for rotatably connecting said movable member to said immovable member.

3. An automatic original feeding apparatus according to claim 2, wherein said biasing members are interposed between said immovable member and said movable member.

4. An automatic original feeding apparatus according to claim 1, wherein a plurality of said supporting means are attached on the main body of said image forming apparatus in spaced apart relationship with each other.

5. An automatic original feeding apparatus according to claim 1, wherein said biasing members are juxtaposed.

6. An automatic original feeding apparatus according to claim 1, wherein said at least one of said biasing members with the adjusting mechanism is set to a weaker spring force than another of said biasing members without the adjusting mechanism.

7. An image forming apparatus comprising automatic original feeding means for conveying an original to said predetermined location in the main body of the image forming apparatus, reading means for reading the image information of the original conveyed to said predetermined location, and image forming means for forming an image on a sheet material on the basis of the image information read by said reading means, said automatic original feeding means being an automatic original feeding apparatus to any one of claims 1 to 6.

8. A supporting apparatus, comprising:

an upper body;

a lower body; and supporting means, said supporting means including:

an opening and closing mechanism interposed between the lower body and the upper body and permitting a rotating operation of the upper body relative to the lower body; and a plurality of biasing members for biasing the upper body so as to offset a rotational force by a gravity thereof, and mitigate the operation load with which the upper body is opened or closed, at least one of said biasing members having an adjusting mechanism for adjusting a biasing force.

9. A supporting apparatus according to claim 8, wherein said opening and closing mechanism has:

an immovable member;

a movable member; and a rotary shaft for rotatably connecting said movable member to said immovable member.

10. A supporting apparatus according to claim 9, wherein said biasing members are interposed between said immovable member and said movable member.

11. A supporting apparatus according to claim 8, wherein a plurality of said supporting means are attached on the lower body in spaced apart relationship with each other.

12. A supporting apparatus according to claim 8, wherein said biasing members are juxtaposed.

13. A supporting apparatus according to claim 8, wherein said at least one of said biasing members with the adjusting mechanism is set to a weaker spring force than another of said biasing members without the adjusting mechanism.

* * * * *

UNITED STATES PATENT AND TRADEMARK OFFICE

CERTIFICATE OF CORRECTION

PATENT NO. : 6,615,019 B2
DATED : September 2, 2003
INVENTOR(S) : Hitoshi Fujimoto It is certified that error appears in the above-identified patent and that said Letters Patent is hereby corrected as shown below:

Column 2,
Line 18, “forced” should read -- force --.

Column 3,
Line 42, “referenced” should read -- reference --.
Line 63, “1id” should read -- 11d --.

Column 4,
Line 28, “sheep” should read -- sheet --.

Column 7,
Line 8, “arrow” should read -- arrows --.
Line 61, “arrow” should read -- arrows --.

Column 8,
Line 24, “rotatable” should read -- rotatably --.

Column 10,
Line 9, “apparatus” should read -- apparatus according --.

Signed and Sealed this

Twentieth Day of January, 2004

JON W. DUDAS
*Acting Director of the United States Patent and Trademark Office*